US007484829B2

(12) United States Patent
Sugahara

(10) Patent No.: US 7,484,829 B2
(45) Date of Patent: Feb. 3, 2009

(54) LIQUID DROPLET JETTING APPARATUS HAVING LIQUID-REPELLENT JETTING SURFACE, NOZZLE PLATE HAVING LIQUID-REPELLENT JETTING SURFACE, AND METHOD FOR PRODUCING THE NOZZLE PLATE

(75) Inventor: Hiroto Sugahara, Aichi-ken (JP)

(73) Assignee: Brother Kogyo kabushiki Kaisha, Nagoya-shi, Aichi-ken (JP)

( * ) Notice: Subject to any disclaimer, the term of this patent is extended or adjusted under 35 U.S.C. 154(b) by 381 days.

(21) Appl. No.: 11/354,833

(22) Filed: Feb. 16, 2006

(65) Prior Publication Data

US 2006/0181575 A1 Aug. 17, 2006

(30) Foreign Application Priority Data

Feb. 16, 2005 (JP) ..... 2005-039577

(51) Int. Cl.
*B41J 2/135* (2006.01)

(52) U.S. Cl. ..... 347/45; 347/47

(58) Field of Classification Search ..... 347/20, 347/44, 45, 47, 56
See application file for complete search history.

(56) References Cited

U.S. PATENT DOCUMENTS 6,799,832 B1 * 10/2004 Adavikolanu et al. ..... 347/45
2002/0001016 A1 1/2002 Aono et al. ..... 347/47
2002/0140774 A1 10/2002 Miki et al. ..... 347/44
2004/0174411 A1 9/2004 Sumiya et al. ..... 347/47
2004/0196332 A1 10/2004 Miki et al. ..... 347/47

FOREIGN PATENT DOCUMENTS

JP S63-009550 A 1/1988
JP 2002 292877 10/2002
JP 2002 355957 12/2002
JP 2005-007789 A 1/2005

OTHER PUBLICATIONS

European Patent Office, European Search Report for Related Application No. EP 06003023, dated Jul. 13, 2007.

* cited by examiner

*Primary Examiner*—Juanita D Stephens
(74) *Attorney, Agent, or Firm*—Baker Botts L.L.P.

(57) ABSTRACT

A plurality of nozzles is formed in a nozzle plate. A first liquid repellent film which surrounds an ejecting port of each of the nozzles and which has a liquid repellent property higher than a liquid repellent property of an inner surface of the nozzle is formed on an ink discharge surface. A second liquid repellent film which has a liquid repellent property higher than the liquid repellent property of the first liquid repellent film is formed on an outer side of the first liquid repellent film. A boundary between the first liquid repellent film and the second liquid repellent film is on a circle which is concentric with a circle forming a circumference of the ejecting port of the nozzle. Discharge characteristics of liquid droplets which are discharged from the nozzle can be stabilized.

18 Claims, 12 Drawing Sheets

LIQUID DROPLET JETTING APPARATUS HAVING LIQUID-REPELLENT JETTING SURFACE, NOZZLE PLATE HAVING LIQUID-REPELLENT JETTING SURFACE, AND METHOD FOR PRODUCING THE NOZZLE PLATE

BACKGROUND OF THE INVENTION

1. Field of the Invention

The present invention relates to a liquid droplet jetting apparatus which discharges liquid droplets, and a nozzle plate which is used in the liquid droplet jetting apparatus.

2. Description of the Related Art

An ink-jet head which discharges ink from nozzles onto a recording paper is available as a liquid-droplet jetting apparatus which discharges or jets liquid droplets. In this ink-jet head, pressure is applied to the ink by various kinds of actuators and the ink is discharged from the nozzles. Then, after the discharge of the ink, the ink is drawn in the nozzles because the pressure in ink channels connected to the nozzles is decreased. However, after the discharge of the ink, when the ink is not completely drawn into the nozzles and a portion or part of the ink is adhered to an ink discharge surface on which ejecting ports of the nozzles are formed, during a subsequent ink discharge, an amount of ink discharged and a direction of discharge are varied in some cases and there is a possibility that the print quality is degraded. In view of this, in a general ink-jet head, a water repellent treatment is performed on the ink discharge surface so that the ink is hardly adhered around the ejecting port of the nozzle.

However, only by performing the water repellent treatment on the ink discharge surface, it is difficult to prevent completely the ink from adhering in the vicinity of the ejecting port of the nozzle. For example, when a viscosity of the ink is decreased due to a rise in the temperature, a large amount of ink is overflowed or outflowed from the nozzle to the ink discharge surface. The outflowed ink moves freely on the ink discharge surface and there is a possibility that a part of the ink moving freely is accumulated or remains around the ejecting port of the nozzle. In view of this, an ink-jet head which is capable of preventing the accumulation of the ink around the ejecting port of the nozzle even when the ink is adhered to the ink discharge surface is proposed.

For example, in an ink-jet head described in U.S. Patent Application Publications No. US 2002/140774 A1 and No. US 2004/196332A1 corresponding to Japanese Patent Application Laid-open No. 2002-292877, a first area which is concentric with the ejecting port is provided around the ejecting port of the nozzle, and a second area having a liquid repellent property lower than a liquid repellent property of the first area is provided at an area other than the first area. Therefore, the ink adhered to the first area around the ejecting port of the nozzle is moved to the second area having the liquid repellent property lower than the liquid repellent quality of the first area, and the ink is hardly accumulated or remains around the ejecting port.

SUMMARY OF THE INVENTION

In an ink-jet head of U.S. Patent Application Publications No. US 2002/140774 A1 and No. US 2004/196332A, when the ink is overflowed to the first area around the ejecting port at the time of discharge, a part of the overflowed ink may move from the first area to the second area but the remaining ink is drawn into the nozzle. However, according to the findings of the inventor, since the ink overflowed to the first area is spread in an irregular shape every time when the ink is drawn into the nozzle, a meniscus of the ink inside the nozzle has a shape with its center shifted from the central axis of the nozzle. Due to the shift in the shape of the meniscus, the direction of discharge at the time of a subsequent ink discharge onward is wobbled and the ink is not discharged at an intended landing position, thereby causing the degradation of print quality.

An object of the present invention is to provide a liquid-droplet jetting apparatus which can maintain a satisfactory discharge stability even when the liquid from the nozzle is adhered to the liquid droplet discharge surface, and a nozzle plate which is used in the liquid droplet jetting constant, the shape of the liquid overflowed to the outside of the nozzle is axisymmetrical with respect to the central axis of the nozzle. Therefore, even when the liquid is returned to the inside of the nozzle, the meniscus of the liquid in the nozzle is axisymmetrical with respect to the central axis and thus there is no shift in the direction of discharge of the liquid droplet during the subsequent discharge of the liquid droplet. Accordingly, it is possible to stabilize discharge characteristics of the liquid droplets. In should be noted that in the present patent application, the term "first liquid repellent area surrounding the ejecting port" means that the first liquid repellent area is adjacent to the ejecting port, and that there is no another area between the ejecting port and the first liquid repellent area.

A shape of the ejecting port of the liquid droplet jetting apparatus of the present invention may be circular. Accordingly, the liquid overflowed to the outside of the nozzle at the time of the discharge of liquid droplets is spread over the entire first liquid repellent area, but not moved from the first liquid repellent area to the second liquid repellent area. Therefore, it is possible to suppress the spreading of the liquid on the liquid droplet discharge surface and there is no variation in the amount of the liquid droplet discharged during the subsequent discharge and thereafter. Moreover, since the shape of the liquid overflowed to the outside of the nozzle becomes circular which is axisymmetrical with respect to the apparatus.

According to a first aspect of the present invention, there is provided a liquid droplet jetting apparatus which includes a nozzle plate and a channel unit. The nozzle plate includes a nozzle which discharges a liquid droplet, and a liquid droplet discharge surface in which an ejecting port of the nozzle is formed. The channel unit communicates with the nozzle. The liquid droplet discharge surface includes a first liquid repellent area surrounding the ejecting port and a second liquid repellent area which is adjacent to the first liquid repellent area and which surrounds the first liquid repellent area. A liquid repellent property of the first liquid repellent area is lower than a liquid repellent property of the second liquid repellent area.

According to the liquid droplet jetting apparatus of the present invention, a liquid overflowed to an outside of the ejecting port of the nozzle at the time of discharge of the liquid droplet is spread over the entire first liquid repellent area and is not moved from the first liquid repellent area to the second liquid repellent area. Therefore, it is possible to suppress the spreading of the ink and there is no variation in the amount of liquid droplet which is discharged during the subsequent liquid droplet discharge. Moreover, when a boundary between the first liquid repellent area and the second liquid repellent area is provided such that a shortest distance with respect to a circumference of the ejecting port is always central axis of the nozzle, when this liquid is returned into the nozzle the shape of the meniscus of the liquid in the nozzle is also axisymmetrical with respect to the central axis of the nozzle, and thus there is no shift in the discharge direction of liquid droplet during the subsequent discharge of the liquid droplets. Accordingly, it is possible to stabilize the discharge characteristics of liquid droplet.

Moreover, in the liquid droplet jetting apparatus of the present invention, it is desirable that the liquid repellent property of the first liquid repellent area is higher than a liquid repellent property of an inner surface of the nozzle. Accordingly, the liquid spread to the first liquid repellent area moves easily to the inside of the nozzle and the liquid is drawn assuredly into the nozzle after the discharge, thereby enabling to confine or retain the liquid to the inside of the nozzle. Furthermore, since it is possible to position a circumference of the meniscus stably on the boundary between the first liquid repellent area and the inner surface of the nozzle, even when a pressure is applied to the liquid inside the nozzle by external vibration, the meniscus is hardly deviated from the ejecting port of the nozzle and thus the overflow of the liquid can be prevented.

The liquid droplet jetting apparatus of the present invention may be an ink-jet head which is usable in an ink-jet printer.

According to a second aspect of the present invention, there is provided a nozzle plate including a nozzle which discharges a liquid droplet, and a liquid droplet discharge surface in which an ejecting port of the nozzle is formed; wherein the liquid droplet discharge surface includes a first liquid repellent area which surrounds the ejecting port, and a second liquid repellent area which is adjacent to the first liquid repellent area and which surrounds the first liquid repellent area; and a liquid repellent property of the first liquid repellent area is lower than a liquid repellent property of the second liquid repellent area.

According to the nozzle plate of the present invention, the liquid overflowed to the outside of the nozzle at the time of discharge of liquid droplet is spread over the entire first liquid repellent area and is not moved from the first liquid repellent area to the second liquid repellent area. Therefore, there is no variation in the amount of liquid overflowed to the outside. Moreover, when the boundary between the first liquid repellent area and the second liquid repellent area is provided such that the shortest distance with respect to the circumference of the ejecting port is always constant, the shape of the liquid overflowed to the outside of the nozzle is axisymmetrical with respect to the central axis of the nozzle and the ejecting port. Therefore, when the liquid is returned to the inside of the nozzle, the meniscus of the liquid in the nozzle is also axisymmetrical with respect to the central axis of the nozzle and thus there is no shift in the discharge direction of liquid droplet during the subsequent discharge of the liquid droplets. Accordingly, it is possible to stabilize the discharge characteristics of the liquid droplets.

Further, in the nozzle plate of the present invention, the ejecting port may have a circular shape. Accordingly, the liquid overflowed to the outside of the nozzle at the time of discharge of liquid droplet is spread over the entire first liquid repellent area, but not moved from the first liquid repellent area to the second liquid repellent area. Therefore, there is no variation in the amount of liquid overflowed from the nozzle to the outside of the nozzle. Furthermore, since the shape of the liquid overflowed to the outside of the nozzle becomes circular which is axisymmetrical with respect to the central axis of the nozzle, when this liquid is returned into the nozzle, the shape of the meniscus of the liquid in the nozzle is also axisymmetrical with respect to the central axis of the nozzle, and there is no shift in the discharge direction of liquid droplet during the subsequent discharge of the liquid droplets. Accordingly, it is possible to stabilize the discharge characteristics of the liquid droplets.

Moreover, in the nozzle plate of the present invention, it is desirable that the liquid repellent property of the first liquid repellent area is higher than a liquid repellent property of an inner surface of the nozzle. Accordingly, the liquid spread to the first liquid repellent area moves easily to the inside of the nozzle, and thus the liquid is drawn assuredly into the nozzle after the discharge, thereby enabling to retain the liquid to the inside of the nozzle. Furthermore, since it is possible to position the circumference of the meniscus stably on the boundary between the first liquid repellent area and the inner surface of the nozzle, even when the pressure is applied to the liquid inside the nozzle by the external vibration, the meniscus is hardly deviated from the ejecting port of the nozzle and the overflow of the liquid can be prevented.

In the liquid droplet jetting apparatus and the nozzle plate of the present invention, a wetting angle of the second liquid repellent area may be higher, by not less than 20°, than a wetting angle of the first liquid repellent area; the first liquid repellent area may surround the ejecting port in concentric with the ejecting port; and a width of an outer circumference of the first liquid repellent area may be in a range of 1.1 times to 1.5 times of a diameter of the ejecting port.

According to a third aspect of the present invention, there is provided a method of producing a nozzle plate of the present invention, the method including a liquid repellent film forming step of forming a liquid repellent film on one surface of a substrate in which a nozzle is to be formed; and a light ray irradiating step of irradiating a light ray on a portion of the liquid repellent film which surrounds an ejecting port of the nozzle to form a first liquid repellent area in which a liquid repellent property is partially lowered.

According to the producing method of the present invention, the liquid repellent film is formed on the substrate in which the nozzle is to be formed and the liquid repellent property of the liquid repellent film is lowered partially by irradiating the light ray on the liquid repellent film. Therefore, by using one type of liquid repellent film, it is possible to easily form the first liquid repellent area and the second liquid repellent area having mutually different liquid repellent properties.

Further, in the method for producing the nozzle plate of the present invention, the substrate may be formed of a metallic material and a nozzle forming step of forming the nozzle in the substrate may be performed before the liquid repellent film forming step. Accordingly, at the time of forming the nozzle in the metallic plate, burr or the like is developed on a surface of the substrate. However, since the liquid repellent film is formed after forming the nozzle, it is possible to form the liquid repellent film after making the surface of the substrate flat and smooth by removing the burr or the like after forming the nozzle.

Moreover, in the method for producing the nozzle plate of the present invention, the substrate may be formed of a synthetic resin material and the nozzle forming step of forming the nozzle in the substrate may be performed after the light ray irradiating step. Accordingly, the nozzle is formed after forming the first liquid repellent area and the second liquid repellent area. Therefore, at the time of irradiating the light ray, it is not necessary to perform a treatment such as filling the nozzle with a resist or the like so that light rays do not irradiate or fall on the inner surface of the nozzle, thereby simplifying the production process.

DETAILED DESCRIPTION OF THE PREFERRED EMBODIMENTS

In the following, a suitable embodiment of the present invention will be described with reference to accompanying drawings. This embodiment is an example in which the present invention is applied to an ink-jet head of an ink-jet printer.

Figure 1:
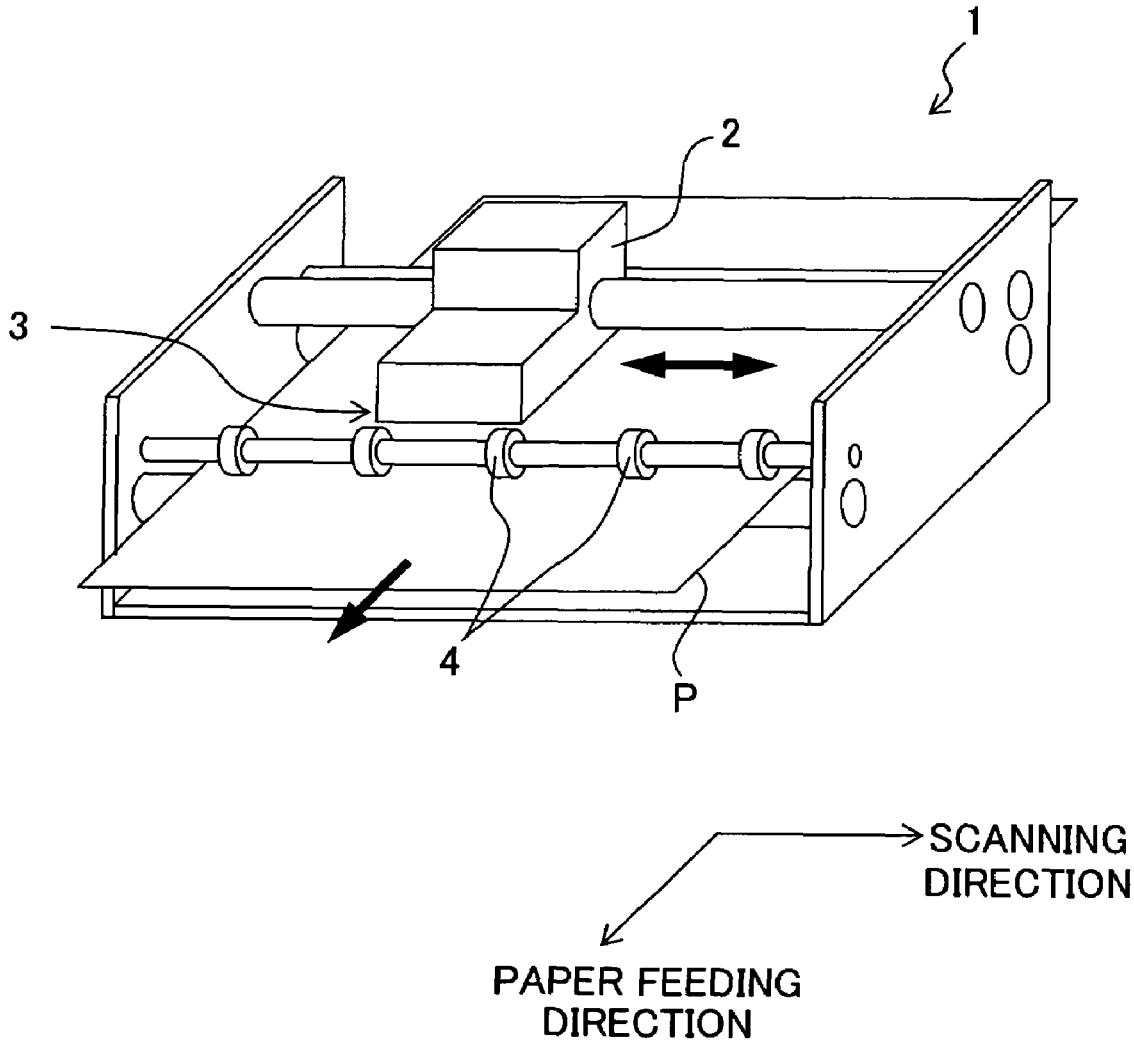
FIG. 1 is a schematic structural diagram of an ink-jet printer according to an embodiment of the present invention.

Firstly, an ink-jet printer 1 which includes an ink-jet head 3 will be described briefly. As shown in FIG. 1, the ink-jet printer 1 includes a carriage 2 which is movable in a left and right direction (scanning direction) in FIG. 1, the ink-jet head 3 (liquid transporting apparatus) of serial type which is provided on the carriage 2 and discharges ink onto a recording paper P, and transporting rollers 4 which carry the recording paper P in a forward direction (paper feeding direction). The ink-jet head 3 moves integrally with the carriage 2 in the left and right direction (scanning direction) and discharges ink onto the recording paper P from ejecting ports 51 of nozzles 50 (see FIGS. 2 to 4) formed in an ink discharge surface 90 of a lower surface of the ink-jet head 3. The recording paper P with an image recorded thereon by the ink-jet head 3 is discharged forward (paper feeding direction) by the transporting rollers 4.

Figure 2:
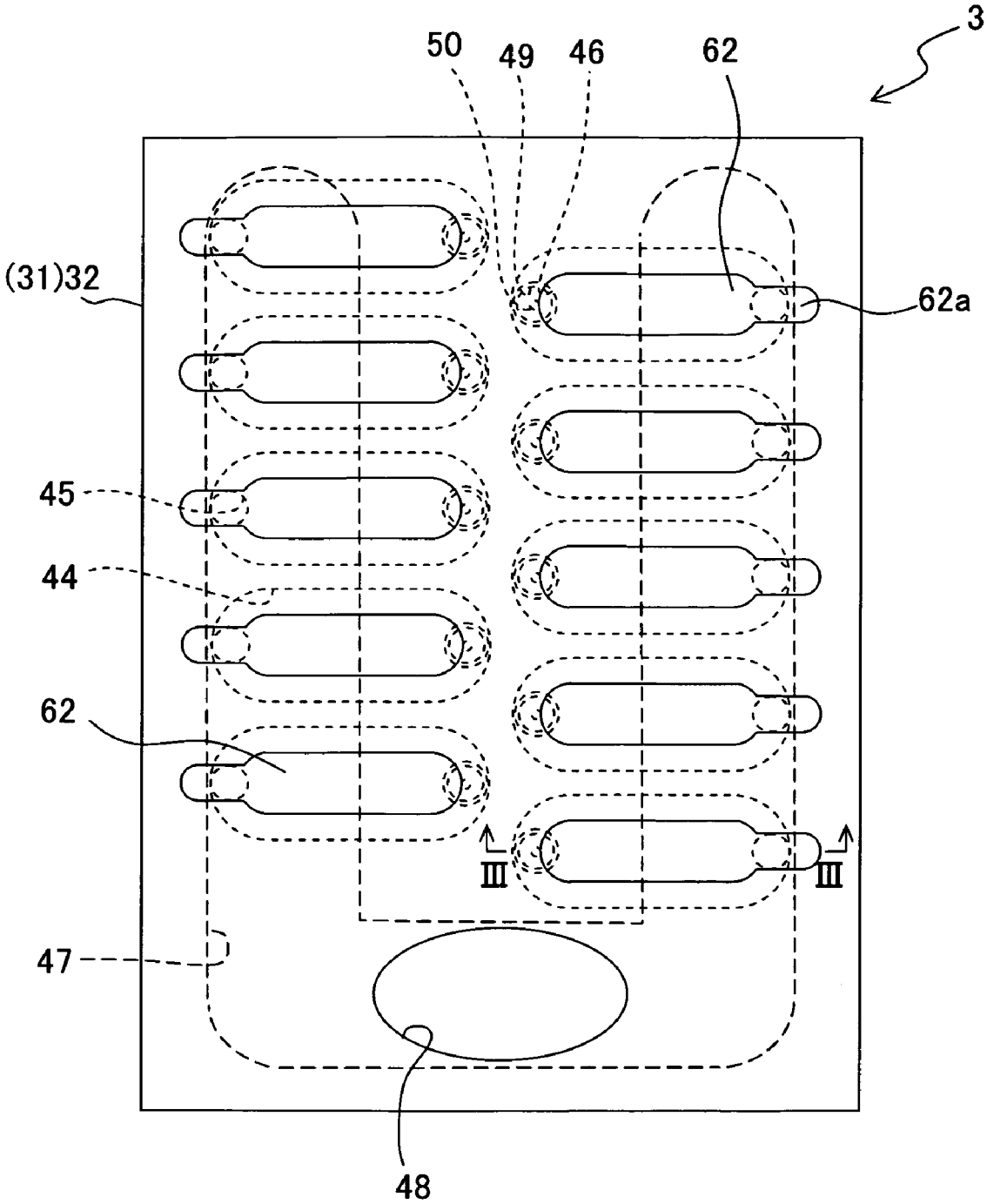
FIG. 2 is an enlarged plan view of an ink-jet head in FIG. 1.
Figure 3:
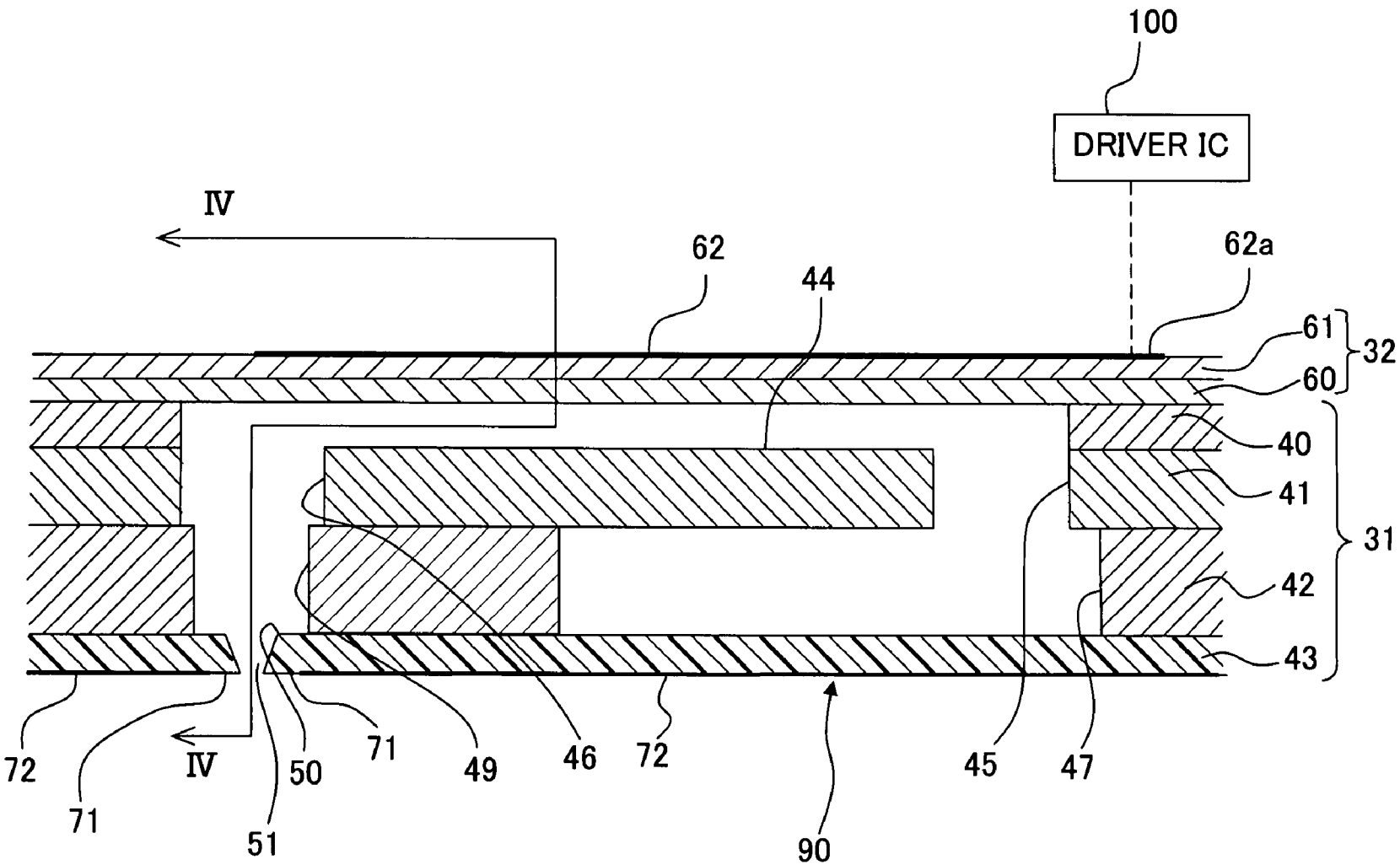
FIG. 3 is a cross-sectional view of FIG. 2 taken along a line III-III.
Figure 4:
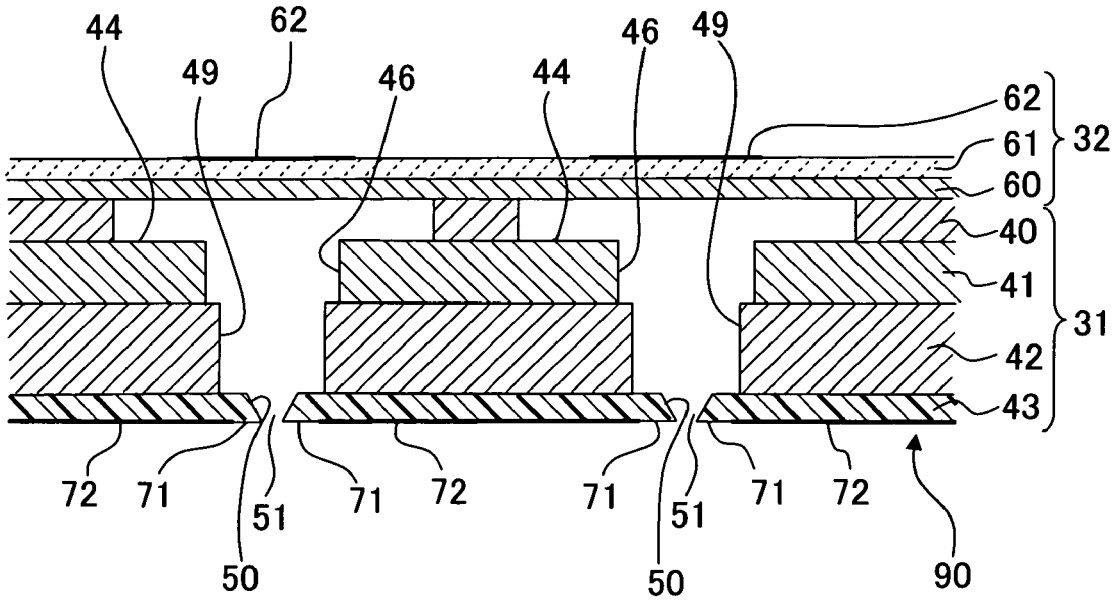
FIG. 4 is a cross-sectional view of FIG. 3 taken along a line IV-IV.

FIG. 2 is a plan view of the ink-jet head 3 in FIG. 1, FIG. 3 is a cross-sectional view of FIG. 2 taken along a line III-III, and FIG. 4 is a cross-sectional view of FIG. 3 taken along a line IV-IV. As shown in FIGS. 2 to 4, the ink-jet head 3 includes a channel unit 31 in which ink channels are formed and a piezoelectric actuator 32 which is arranged on the upper surface of the channel unit 31.

First, the channel unit 31 will be described below. As shown in FIG. 3 and FIG. 4, the channel unit 31 includes a cavity plate 40, a base plate 41, a manifold plate 42, and a nozzle plate 43, and these four plates are joined in stacked layers. Among these four plates, the cavity plate 40, the base plate 41, and the manifold plate 42 are rectangular stainless steel plates. Moreover, the nozzle plate 43 is formed of a high-molecular synthetic resin material such as polyimide and is joined to the lower surface of the manifold plate 42.

As shown in FIGS. 2 to 4, in the cavity plate 40, a plurality of pressure chambers 44 aligned along a plane is arranged. In FIG. 2, a part of the pressure chambers (ten pressure chambers) from among these pressure chambers 44 is shown. Each of the pressure chambers 44 is formed to have a shape substantially elliptical in a plan view and is arranged such that a long axis is the scanning direction (vertical direction in FIG. 2).

Communicating holes 45 and 46 are formed in the base plate 41 at positions which overlap, in a plan view, with both end portions respectively in the long axis direction of the pressure chambers 44. In addition, in the manifold plate 42, a manifold 47 which is extended in two rows in the paper feeding direction (left and right direction in FIG. 2) and overlaps in a plan view with a right end portion or a left end portion of one of the pressure chambers 44 in FIG. 2 is formed. Ink is supplied to the manifold 47 from an ink tank (not shown in the diagram) via an ink supply port 48 formed in the cavity plate 40. Moreover, a communicating hole 49 is formed at a position which overlaps in a plan view with an end portion on a side of each of the pressure chambers 44, the side being opposite to the manifold 47. Furthermore, a plurality of nozzles 50 are formed in the nozzle plate 43 at positions each of which overlaps in a plan view with an end portion on a side of one of the pressure chambers 44, the side being opposite to the manifold 47. The lower surface of the nozzle plate 43 is the ink discharge surface 90 (liquid droplet discharge surface) in which the ejecting ports 51 of the nozzles 50 are formed, and the ejecting port 51 of each of the nozzles 50 is formed circular in shape as shown in FIG. 5.

As shown in FIG. 3, the manifold 47 communicates with the pressure chamber 44 via the communicating hole 45, and the pressure chamber 44 communicates with the nozzle 50 via the communicating holes 46 and 49. Thus, a plurality of individual ink channels from the manifold 47 to the nozzle 50 via the pressure chamber 44 is formed in the channel unit 31.

Figure 5:
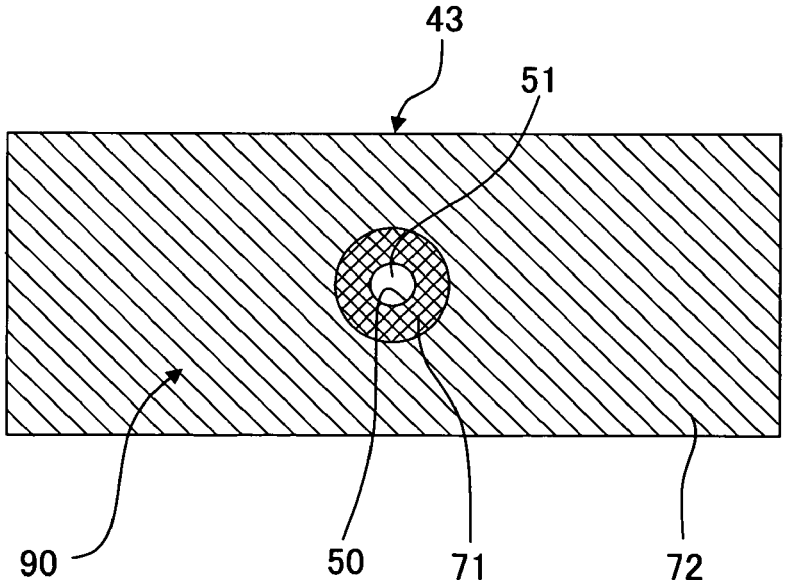
FIG. 5 is an enlarged plan view of a nozzle plate.

FIG. 5 is an enlarged view of an area around the ejecting port 51 of the nozzle 50 on the ink discharge surface 90 in FIG. 3 and FIG. 4. As shown in FIG. 5, a first liquid repellent film 71 (first liquid repellent area) having a liquid repellent property higher than a liquid repellent property of an inner surface of the nozzle 50 is formed in an annular shape on the ink discharge surface 90 at an area surrounding the ejecting port 51 of the nozzle 50. Moreover, a second liquid repellent film 72 (second liquid repellent area) having a liquid repellent property further higher than the liquid repellent property of the first liquid repellent film 71 is formed at an area adjacent to and on an outer side of the first liquid repellent film 71 of the ink discharge surface 90. A boundary between the first liquid repellent film 71 and the second liquid repellent film 72 is on a circle which is concentric with a circle forming a circumference of the ejecting port 51 of the nozzle 50. In other words, the boundary is provided such that the shortest distance from the circumference of the ejecting port 51 of the nozzle 50 is always constant. The first liquid repellent film 71 and the second liquid repellent film 72 are formed of a fluorine based resin, and a method for forming these films will be described in detail later. A diameter of the ejecting port 51 of the nozzle 50 is normally about 20 μm. A width of the first liquid repellent film 71 in a radial direction is in a range of 2 μm to 10 μm, and preferably in a range of 2 μm to 5 μm. When the diameter of the nozzle is ϕ, it is desirable that a diameter of an outer circumference of the first liquid repellent film 71 is in a range of 1.1 ϕ to 1.5 ϕ. When the diameter of the outer circumference of the first liquid repellent film 71 is more than 1.5 ϕ, the first liquid repellent film 71 becomes too wet and there is a possibility that the liquid does not return to the inner circumference of the first liquid repellent film 71. When the diameter of the outer circumference of the first liquid repellent film 71 is smaller than 1.1 ϕ, it becomes difficult to hold or retain the liquid in the first liquid repellent film 71.

A wetting angle of the inner surface of the nozzle 50 of the present embodiment is about 20°, a wetting angle of a surface of the first liquid repellent film 71 is about 50°, and a wetting angle of a surface of the second liquid repellent film 72 is about 70°. Normally, it is desirable that the wetting angle of the inner surface of the nozzle 50 is not more than 30°, the wetting angle of the surface of the first liquid repellent film 71 is not less than 40°, and the wetting angle of the surface of the second liquid repellent film 72 is not less than 60°. Moreover, it is desirable that a difference between the wetting angle of the surface of the first liquid repellent film 71 and the wetting angle of the surface of the second liquid repellent film 72 is not less than 20°. The first liquid repellent film 71 and the second liquid repellent film 72 are provided so that the ink hardly remains near or in the vicinity of the ejecting port 51 after the ink is discharged from the nozzle 50, and the detailed action and effect of the first liquid repellent film 71 and the second liquid repellent film 72 will be described later.

Next, the piezoelectric actuator 32 will be described below. As shown in FIG. 3 and FIG. 4, the piezoelectric actuator 32 includes a vibration plate 60, a piezoelectric layer 61, and a plurality of individual electrodes 62. The vibration plate 60 is electroconductive, is arranged on a surface of the cavity plate 40, and is joined to the cavity plate 40. The piezoelectric layer 61 is formed continuously on a surface of the vibration plate 60 to spread across the pressure chambers 44. The individual electrodes 62 are formed on a surface of the piezoelectric layer 61 corresponding to the pressure chambers 44 respectively.

The vibration plate 60 is made of a metallic material such as an iron alloy like stainless steel, a nickel alloy, an aluminum alloy, a titanium alloy, or the like. The vibration plate 60 is joined to a joining portion 40a of the cavity plate 40 so as to cover the pressure chambers 44. The vibration plate 60 also serves as a common electrode which faces the plurality of individual electrodes 62 and generates an electric field in the piezoelectric layer 61 between the individual electrodes 62 and the vibration plate 60. The vibration plate 60 is grounded and kept at a ground potential.

On the surface of the vibration plate 60, the piezoelectric layer 61, which is ferromagnetic and composed mainly of lead zirconate titanate (PZT) that is a solid solution of lead titanate and lead zirconate, is formed. The piezoelectric layer 61 is formed continuously spreading across the pressure chambers 44. Therefore, the piezoelectric layer 61 can be formed at a time for all of the pressure chambers 44 and thus the formation of the piezoelectric layer 61 is easy. Here, the piezoelectric layer 61 can be formed, for example, by an aerosol deposition method (AD method) in which ultra fine particles of a piezoelectric material are deposited by being collided at a high speed on the surface of the vibration plate 60. Other than this, a method such as a sol-gel method, a sputtering method, a hydrothermal synthesis method, or a CVD (chemical vapor deposition) method can also be used. Furthermore, the piezoelectric layer 61 can also be formed by sticking, on the vibration plate 60, a piezoelectric sheet obtained by sintering a green sheet of PZT.

On the upper surface of the piezoelectric layer 61, the individual electrodes 62 each having a flat shape, substantially elliptical form, and larger in size to some extent than the pressure chamber 44 are formed. Each of these individual electrodes 62 is formed to overlap in a plan view with a central portion of the corresponding pressure chamber 44. The individual electrodes 62 are made of an electroconductive material such as gold, copper, silver, palladium, platinum, and titanium. Moreover, on the upper surface of the piezoelectric layer 61, a plurality of contact portions 62*a* are formed. Each of the contact portions 62*a* extends from one end portion (an end portion on the side of the manifold 47) of one of the individual electrodes up to a portion which does not face one of the pressure chambers 44 in a plan view. The individual electrodes 62 and the contact portions 62*a* can be formed by a method such as a screen printing, the sputtering method, and a vapor deposition method. Moreover, the contact portions 62*a* are connected to a driver IC 100 via a flexible printed circuit board (FPC) which is not shown in the diagram.

Figure 6:
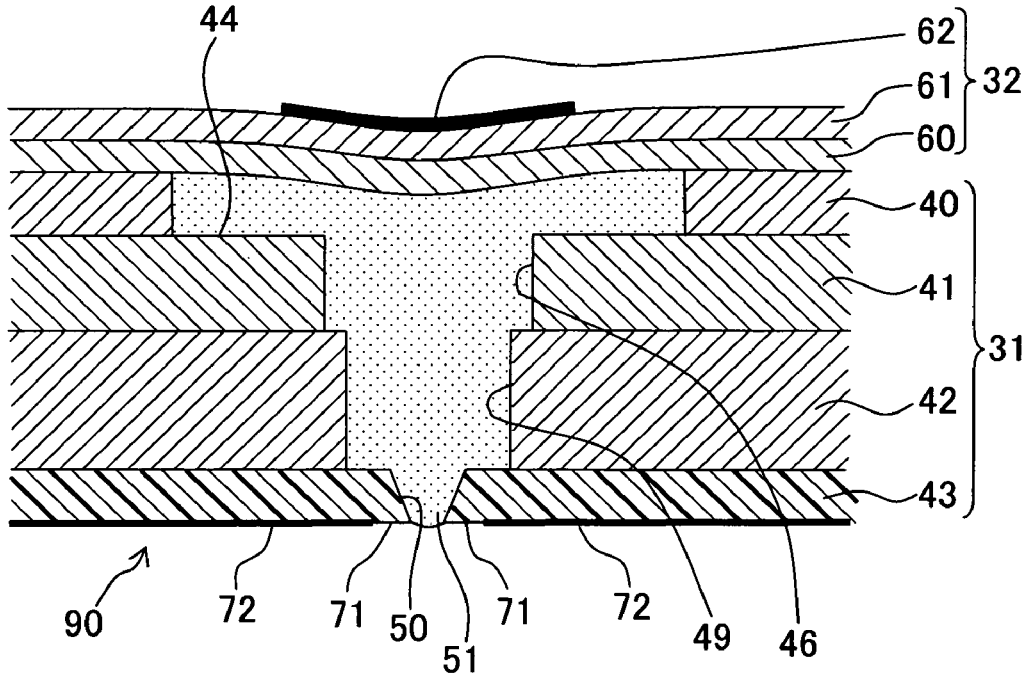
FIG. 6 is a partially enlarged cross-sectional view of the ink-jet head showing a state when a voltage is applied to an individual electrode in FIG. 4.

Next, an action at the time of discharging the ink from the nozzle 50 will be described with reference to FIGS. 6 to 10. When the ink is not discharged, a drive voltage is supplied in advance from the driver IC 100 to the individual electrode 62. At this time, an electric field in a direction of thickness is generated in the piezoelectric layer 61 which is sandwiched between the individual electrode 62 to which the drive voltage is supplied and the vibration plate 60 which serves as a common electrode and kept at the ground potential. As the electric field is generated, a portion of the piezoelectric layer 61 directly below the individual electrode 62 is contracted in a horizontal direction which is perpendicular to the direction of thickness which is a direction of polarization. With the contraction of the portion of the piezoelectric layer 61, as shown in FIG. 6, the vibration plate 60 and the area of the piezoelectric layer 61 facing the pressure chamber 44 are deformed to project toward the pressure chamber 44. At this time, an overflow of the ink from the ejecting port 51 of the nozzle 50 is prevented by the first liquid repellent film 71 having the liquid repellent property higher than the liquid repellent property of the inner surface of the nozzle 50, and a meniscus of the ink is positioned at a boundary between the inner surface of the nozzle 50 and the first liquid repellent film 71.

Figure 7:
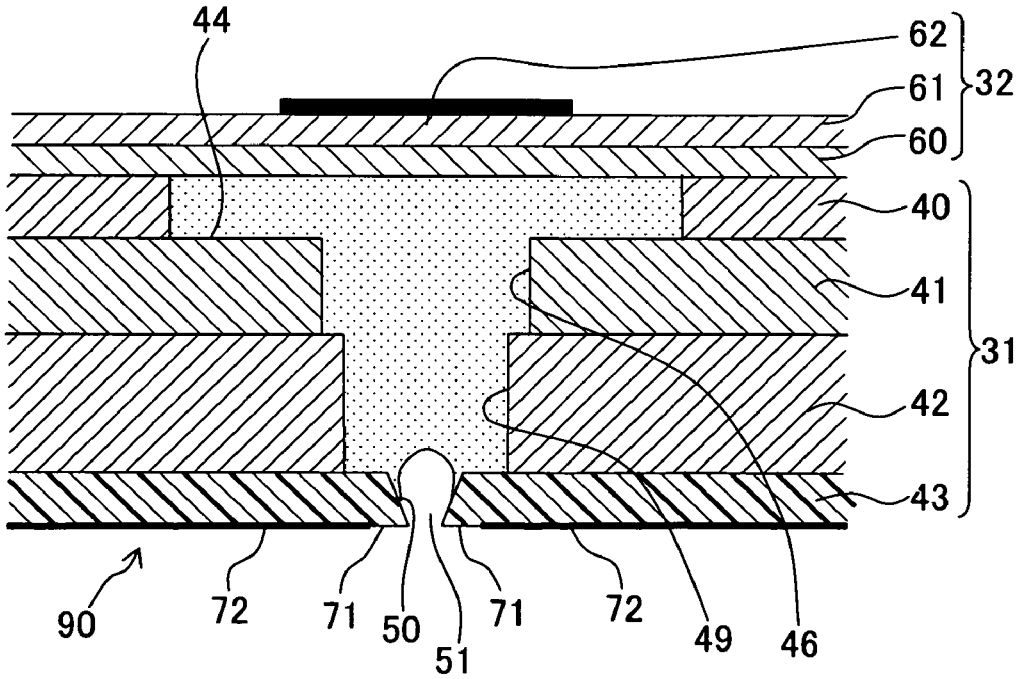
FIG. 7 is a cross-sectional view showing a state when the application of drive voltage to the individual electrode in FIG. 4 is stopped.

When the ink is discharged from the nozzle 50, the application of voltage to the individual electrode 62 corresponding to the nozzle 50 which discharges ink is stopped, and the individual electrode 62 is at the ground potential. Then, as shown in FIG. 7, the piezoelectric layer 61 and the vibration plate 60 become flat, a volume of the pressure chamber 44 is increased, and a pressure inside the pressure chamber 44 is decreased. As the pressure in the pressure chamber 44 is decreased, the ink inflows from the manifold 47 (refer to FIG.

3) into the pressure chamber 44. At this time, the ink inside the nozzle 50 is also drawn towards the pressure chamber 44.

Figure 8:
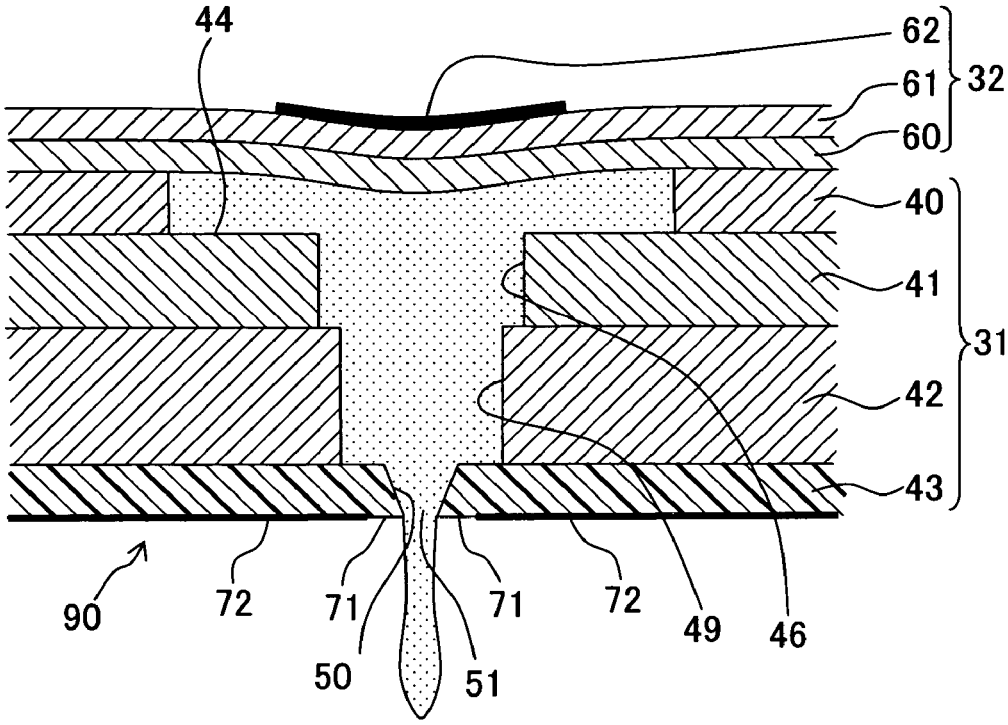
FIG. 8 is a cross-sectional view showing a state when the drive voltage is applied once again to the individual electrode in FIG. 7.
Figure 9:
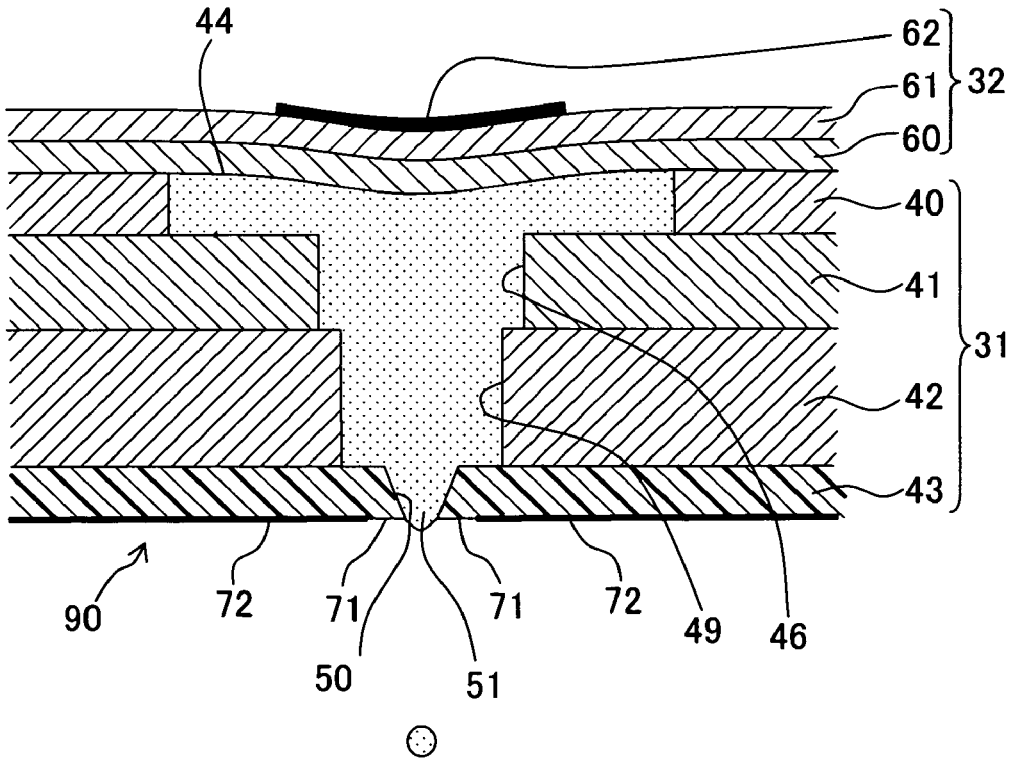
FIG. 9 is a cross-sectional view showing a state when the ink, discharged from the nozzle in FIG. 8, is ejected.
Figure 10:
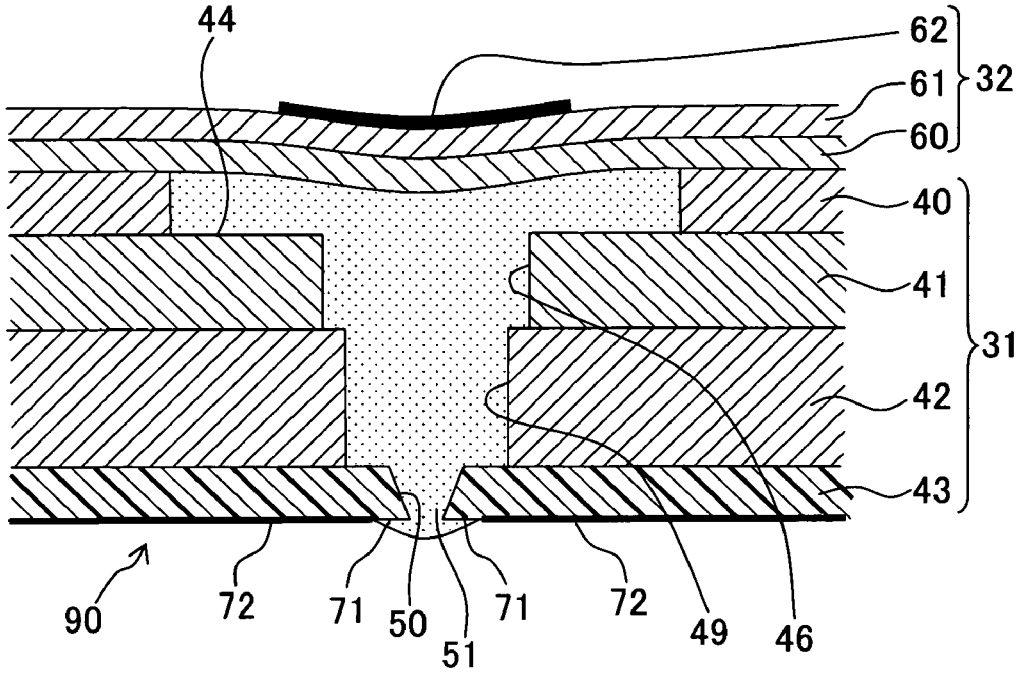
FIG. 10 is a cross-sectional view showing a state after the discharge of the ink in FIG. 9.

Next, when the drive voltage is applied once again to the individual electrode 62 for which the application of voltage was stopped, then as shown in FIG. 8, the portion directly below the individual electrode 62 is contracted once again in the horizontal direction perpendicular to the direction of thickness which is the direction of polarization, and the vibration plate 60 and the piezoelectric layer 61 in the area facing the pressure chamber 44 are deformed to project toward the pressure chamber 44. Accordingly, the volume of the pressure chamber 44 is decreased once again and the pressure in the pressure chamber 44 is increased. Therefore, as shown in FIG. 9, the ink is discharged from the nozzle 50 and a dot is formed on the recording paper P (see FIG. 1).

At this time, the ink inside the nozzle 50 is forced out by a pressure wave remaining in the pressure chamber 44, and the ink is overflowed to the outside from the ejecting port 51 of the nozzle 50 on the discharge surface 90. In this case, since the liquid repellent property of the second liquid repellent film 72 is higher than the liquid repellent property of the first liquid repellent film 71 which surrounds the ejecting port 51, the ink overflowed to the outside of the nozzle 50 is spread over the entire surface of the first liquid repellent film 71, but is not moved from the first liquid repellent film 71 to the second liquid repellent film 72. Accordingly, the shape of the ink spread on the ink discharge surface 90 becomes circular and axisymmetrical with respect to the central axis of the nozzle 50. Therefore, thereafter, the ink returns from the first liquid repellent film 71 to the nozzle 50 due to the decrease in the pressure of the pressure chamber 44. While the ink returns to the nozzle 50, however, since the shape of the ink on the ink discharge surface 90 is circular and axisymmetrical with respect to the central axis of the ejecting port 51 of the nozzle 50, the ink returns to the nozzle 50 axisymmetrically with respect to the central axis of the nozzle. Accordingly, the shape of the meniscus of the ink returned to the nozzle 50 is also symmetrical with respect to the central axis of the nozzle 50. In other words, it is returned to the state shown in FIG. 6 and the ink can be discharged afterwards in a similar manner. Thus, since the shape of the ink on the ink discharge surface 90 is always maintained to be symmetrical with respect to the central axis of the ejecting port 51 of the nozzle 50, it is possible to prevent the shifting of discharge direction of the ink discharged from the nozzle 50.

The ink-jet head 3 of the present embodiment is structured to enable the so called liquid-droplet gradation in which, while forming one dot on recording paper, the amount of discharge of ink from each nozzle 50 is changed selectively. The liquid-droplet gradation will be described below with reference to a case of performing a three stage liquid-droplet gradation by selecting any one of three different types of discharge modes (small droplet, medium droplet, and large droplet) having mutuallydifferent amounts of ink discharge for each nozzle 50.

Figure 11A:
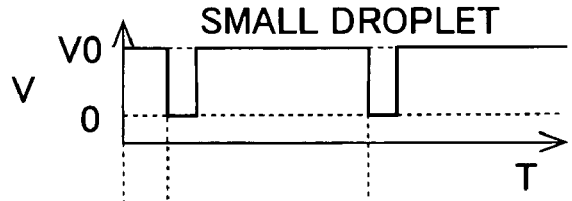
FIG. 11 (FIGS. 11A to 11C) is a diagram showing a voltage to be applied to the individual electrode in FIG. 4 while performing a liquid droplet gradation.
Figure 11B:
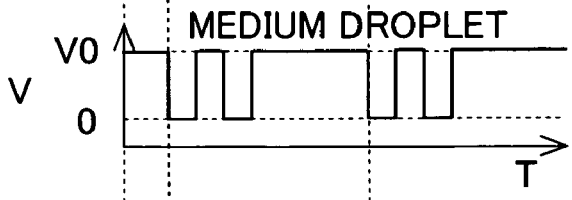
Figure 11C:
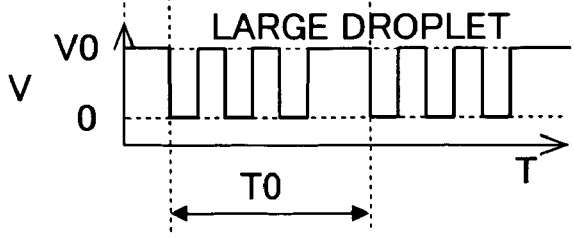

FIG. 11 shows a waveform diagram of driving pulse signals each of which is supplied from the driver IC 100 to the individual electrode corresponding to one of the three types of discharge modes. FIG. 11A is a waveform diagram of a driving pulse signal corresponding to a small droplet; FIG. 11B is a waveform diagram of a driving pulse signal corresponding to a medium droplet; and FIG. 11C is a waveform diagram of a driving pulse signal corresponding to a large droplet.

In the small droplet discharge mode in which the driving pulse signal shown in FIG. 11A is supplied to the individual electrode 62, one pulse is supplied during a printing time $T_0$ in which one dot is formed. When the pulse is supplied, as described earlier, after the application of a drive voltage $V_0$ to the individual electrode 62 is stopped once, the drive voltage is applied again after a time equivalent to a pulse width is elapsed. Therefore, one droplet of ink is discharged from the nozzle 50 during the printing time $T_0$.

On the other hand, in the medium droplet discharge mode in which the driving pulse signal shown in FIG. 11B is supplied to the individual electrode 62, two pulses are supplied during the printing time $T_0$ in which one dot is formed. Therefore, two droplets of ink are discharged consecutively from the nozzle 50 during the printing time $T_0$.

Further, in the large droplet discharge mode in which the driving pulse signal shown in FIG. 11C is supplied to the individual electrode 62, three pulses are supplied during the printing time $T_0$ in which one dot is formed. Therefore, three droplets of ink are discharged consecutively from the nozzle 50 during the printing time $T_0$.

In particular, in the medium droplet discharge mode and the large droplet discharge mode, the waveform of the drive voltage is adjusted so that the ink is allowed to remain positively around the ejecting port 51 of the ink discharge surface 90 and that at the time of the second or third discharge, the subsequent discharge is carried out before the ink overflowed to the ink discharge surface 90 at the immediate prior ink discharge is completely returned to the nozzle 50. In this case, it is possible to discharge an amount of ink which is greater, as compared to the immediate previous discharge, by being added with the ink remained on the ink discharge surface 90.

At this time, when the shape of the ink remained on the ink discharge surface 90 during the second discharge or the third discharge is varied or non-uniform, there is a variation in the ink discharge direction. In the ink-jet head 3 of the present embodiment, however, the ink overflowed to the outside from the nozzle 50 at the time of discharge is spread over the entire area of the first liquid repellent film 71 but not spread up to the second liquid repellent film 72 having the liquid repellent property higher than the liquid repellent property of the first liquid repellent film 71. Therefore, the shape of the ink overflowed on the ink discharge surface 90 is circular and axisymmetrical with respect to the central axis of the nozzle 50. Thereafter, a portion or part of the ink on the ink discharge surface 90 is returned to the nozzle 50 while maintaining the axisymmetrical form. Since the subsequent discharge is carried out in this state, the shape of the ink remained on the ink discharge surface 90 becomes axisymmetrical with respect to the central axis of the nozzle 50. Therefore, the discharge direction of the discharged ink is hardly varied and it is possible to prevent the degradation of a print quality.

Moreover, while discharging the medium droplets or the large droplets, two or three pulse signals having an equal pulse width and distance are supplied as shown in FIG. 11. Accordingly, a time after the pulse signal is supplied until the subsequent pulse signal is supplied is constant. Therefore, the ink, overflowed to the entire area of the first liquid repellent film 71 of the ink discharge surface 90 by the immediate prior discharge, is returned to the nozzle 50 by a constant amount during this constant time. Therefore, at the time of the subsequent discharge of the ink, the amount of ink adhered to the ink discharge surface 90 is always constant. For this reason, the amount of ink discharged is hardly varied and it is possible to prevent the degradation of the print quality.

Figure 12:
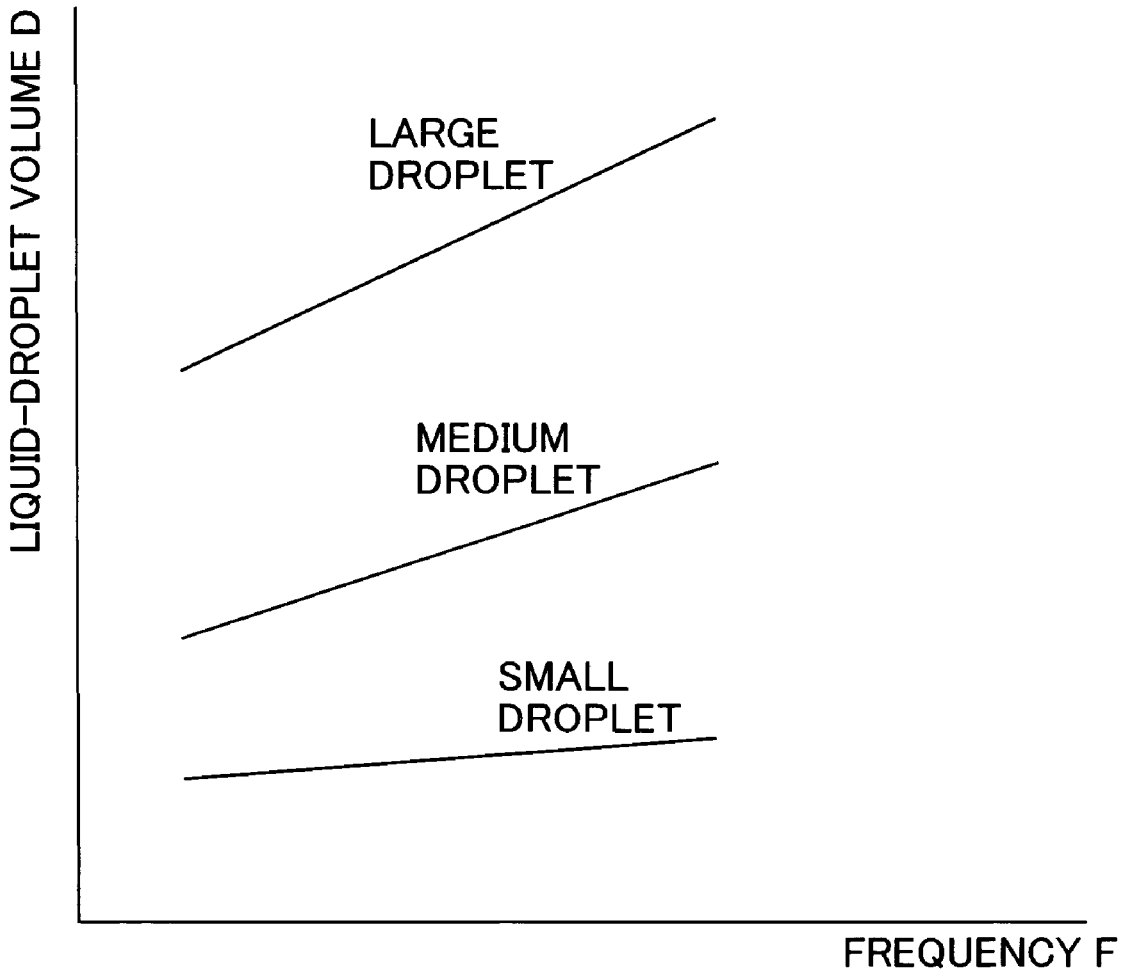
FIG. 12 is a diagram showing a relationship between an amount of the discharged ink and a frequency of a voltage when the voltage is applied as in FIG. 11.

Furthermore, the ink-jet head 3 of the present embodiment is configured such that when forming two or more dots consecutively on the recording paper P, a printing cycle $T_0$ (frequency 1/F) is changed so that the volume of the ink to be discharged is changeable, as shown in FIG. 12.

As explained above, when the ink is discharged from the nozzle 50, the ink overflows from the ejecting port 51 on to the ink discharge surface 90. Furthermore, after the discharge of the ink, the ink overflowed to the ink discharge surface 90 attempts to return into the nozzle 50 due to the decrease in pressure of the pressure chamber 44. However, when the printing cycle $T_0$ of the driving pulse signal is made smaller, in other words, when the frequency F ($=1/T_0$) is increased, the pulse for performing the subsequent discharge of the ink is applied to the individual electrode 62 before the ink overflowed to the ink discharge surface 90 at the time of the previous discharge is completely returned into the nozzle, and thus at the time of the subsequent discharge of the ink, the ink including the ink remained around the ejecting port 51 of the nozzle 50 is discharged from the nozzle 50. Consequently, the volume of the ink discharged at the time of the subsequent discharge is greater than the volume of the ink in the previous discharge. Therefore, as shown in FIG. 12, even with the same discharge mode, by increasing the frequency (decreasing the printing cycle $T_0$), the ink is allowed to remain positively around the ejecting port 51 of the nozzle 50 of the ink discharge surface 90, and the volume of the ink to be discharged can be increased by using the remained ink. Accordingly, a suitable recording can be performed when a high density printing in which a predetermined area of the recording paper P is daubed is required.

In particular, in the ink-jet head 3 of this embodiment, the first liquid repellent film 71 which surrounds the ejecting port 51 of the nozzle 50 and the second liquid repellent film 72 which surrounds the first liquid repellent film 71 are formed, and the boundary between the two liquid repellent films is on a circle concentric with the ejecting port 51 of the nozzle 50. Therefore, as described earlier, when the ink is overflowed to the surrounding of the ejecting port 51 of the nozzle 50 at the time of discharge of the ink, the overflowed ink is spread over the entire area of the first liquid repellent film 71, but is not moved from the first liquid repellent film 71 to the second liquid repellent film 72. Therefore, the shape of the ink on the ink discharge surface 90 is circular and axisymmetrical with respect to the central axis of the nozzle 50. For this reason, at the time of the subsequent discharge of the ink, even the ink remained at the ejecting port 51 is axisymmetrical with respect to the central axis of the nozzle 50 and the direction of discharge of ink is hardly shifted, thereby improving the stability of discharge.

Thus, when the ink is discharged from the nozzle 50, the ink is allowed to overflow positively from the nozzle 50 to the outside to be adhered to the ink discharge surface 90. By doing so, in a case of discharging medium droplets or large droplets, or discharging two or more dots consecutively, the amount of ink to be discharged during the subsequent discharge of ink can be increased by using the ink remained on the ink discharge surface 90. However, when the ink is discharged from the nozzle 50, and when the amount of ink overflowed to the ink discharge surface 90 is small and thus spread on only a portion or part of the first liquid repellent film 71, the shape of the ink on the ink discharge surface 90 is not axisymmetrical with respect to the central axis of the nozzle 50. Therefore, the shape of the meniscus of the ink returned thereafter into the nozzle 50 is not also axisymmetrical with respect to the central axis, and there is a possibility of that the discharge direction of the ink is shifted or deviated. For this reason, the ink-jet head 3 of the present embodiment is designed such that, when the ink is discharged from the nozzle 50, the amount of the ink overflowed around the nozzle 50 of the ink discharge surface 90 always to be an amount for allowing the ink to reach up to the boundary between the first liquid repellent film 71 and the second liquid repellent film 72.

Next, a method of producing the nozzle plate 43 of the present embodiment will be described by referring to FIG. 13. FIG. 13 (13A to 13E) is a process diagram showing steps for producing the nozzle plate 43.

Figure 13A:
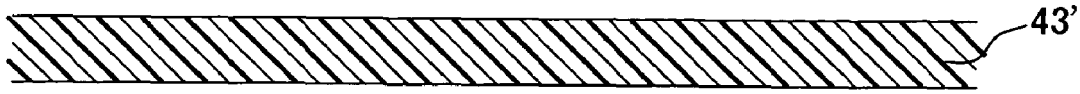
FIG. 13 (13A to 13E) is a process diagram showing steps for producing the nozzle plate.
Figure 13B:
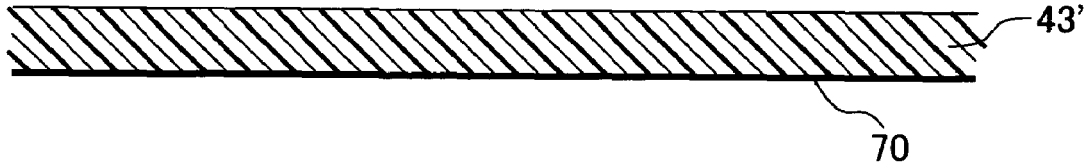

First, a fluorine based resin is coated, on one surface of a substrate 43' made of a high-molecular synthetic resin material such as polyimide as shown in FIG. 13A, to form a liquid repellent film 70 as shown in FIG. 13B (liquid repellent film forming step).

Figure 13C:
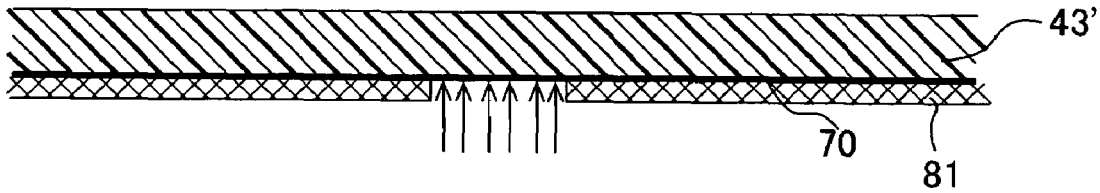

Next, as shown in FIG. 13C, after forming a resist 81 by clamping a thermosetting resin in the form of a film on a surface of the liquid repellent film 70 by a roller or the like while heating the thermosetting resin, at an area on the surface of the liquid repellent film 70 where the second liquid repellent film 72 is to be formed, then light ray such as laser beam is irradiated on an exposed portion of the liquid repellent film 70 which is not covered by the resist 81 (light ray irradiating step). Then, the portion of the liquid repellent film 70 irradiated with the laser beam is degraded and the liquid repellent property of this portion is lowered. This portion in which the liquid repellent property is lowered becomes the first liquid repellent film 71, and a portion which is covered by the resist 81 and on which the laser beam is not irradiated becomes the second liquid repellent film 72. Alternatively, instead of forming the resist 81, a laser beam may be used, which diameter is made to be narrow, for example, by making the laser beam to pass through a mask to form an image via an optical system, and the area of the liquid repellent film 70, which is to become the first liquid repellent firm 71, may be scanned with this laser beam.

Figure 13D:
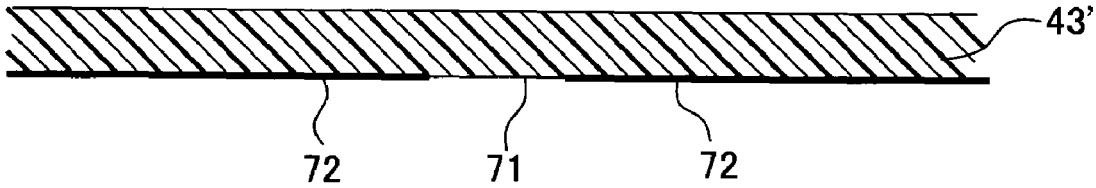
Figure 13E:
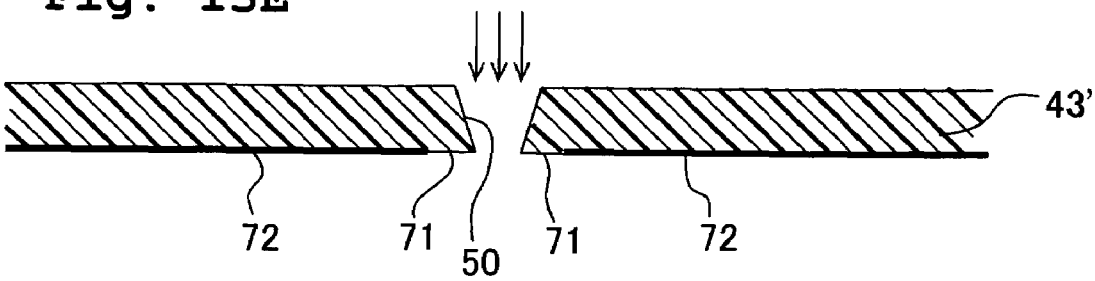

Next, as shown in FIG. 13D, the resist 81 is removed by being dissolved with a solvent, and as shown in FIG. 13E, the nozzle 50 is formed by cutting a hole in the nozzle plate 43 by irradiating excimer laser beam or the like from a surface of the nozzle plate 43 on a side opposite to the other surface where the first liquid repellent film 71 and the second liquid repellent film 72 are formed (nozzle forming step).

In this nozzle manufacturing process, after forming the first liquid repellent film 71 and the second liquid repellent film 72, the nozzle 50 is formed in the substrate 43' which becomes the nozzle plate 43. In other words, since the nozzle 50 is not formed when the laser beam is irradiated to degrade the liquid repellent film70, there is no need to perform a treatment of filling the resist into the inside the nozzle 50 to close the nozzle 50 therewith or the like, thereby simplifying the manufacturing process. Other than the laser beam, ultraviolet ray, electron beam or the like may be used as the light ray to be used in the light ray irradiating step.

Next, modified embodiments in which various modifications are made to this embodiment will be described. Elements or components of the modified embodiments having the same configuration as those of the embodiment are given the same reference numerals and the descriptions therefore are omitted as appropriate.

First Modified Embodiment

Figure 14:
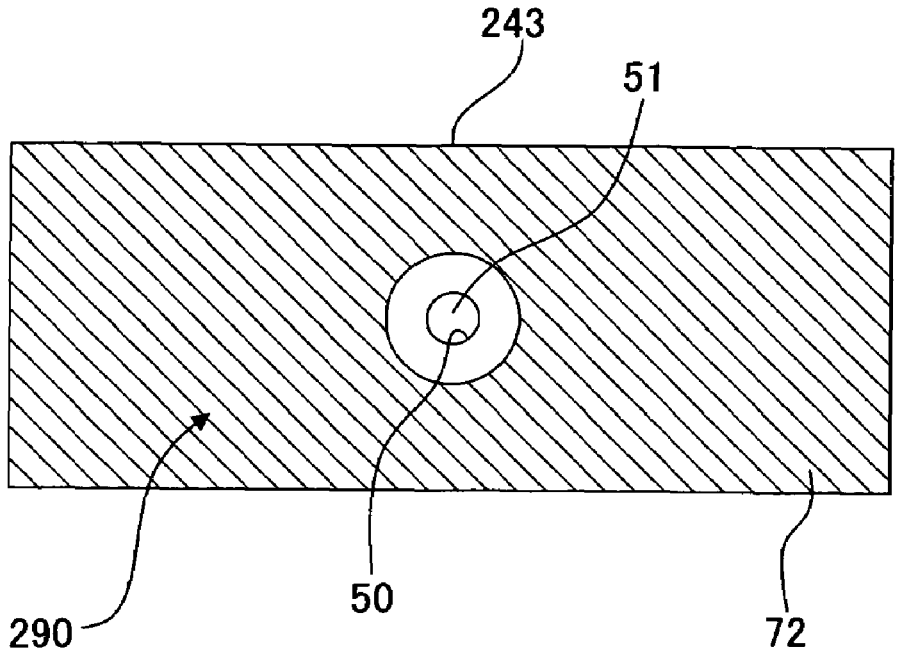
FIG. 14 is a plan view of a nozzle plate of a first modified embodiment corresponding to FIG. 5.

As shown in FIG. 14, a liquid repellent film may not be formed at an annular area which surrounds the nozzle 50 of an ink discharge surface 290. In this case, the liquid repellent property of this annular area (corresponding to the first liquid repellent area) is equivalent to the liquid repellent property of the inner surface of the nozzle 50 and is lower than the liquid repellent property of the second liquid repellent film 72.

Therefore, the ink remaining on the surface of a nozzle plate 243 when the ink is discharged from the nozzle 50 is spread over the entire annular area surrounding the nozzle 50 but is not moved to the second liquid repellent film 72. For this reason, the shape of the ink on the ink discharge surface 290 can be maintained to be circular and axisymmetrical with respect to the central axis of the nozzle 50.

Second Modified Embodiment

Figure 15:
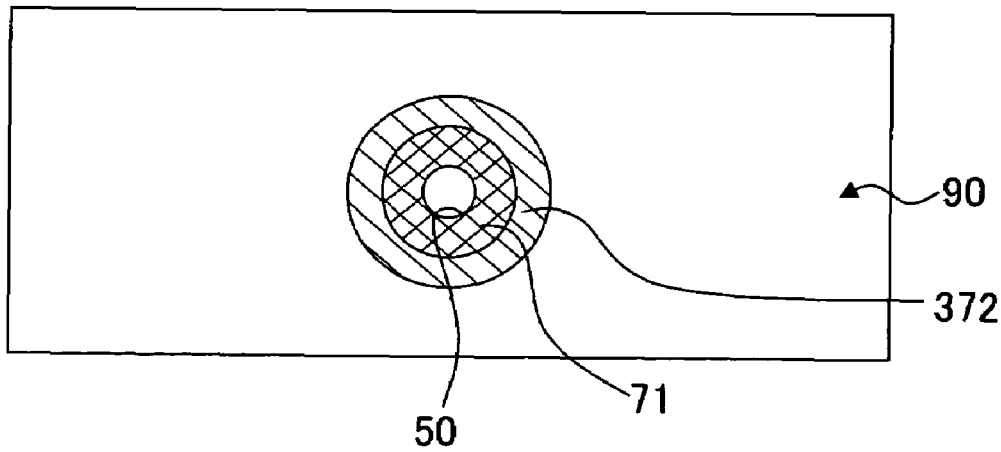
FIG. 15 is a plan view of a nozzle plate of a second modified embodiment corresponding to FIG. 5.

As shown in FIG. 15, a first liquid repellent film 372 which is formed on the outside of the first liquid repellent film 71 of the ink discharge surface 90 may be formed only partially (circular in this case).

Third Modified Embodiment

Figure 16A:
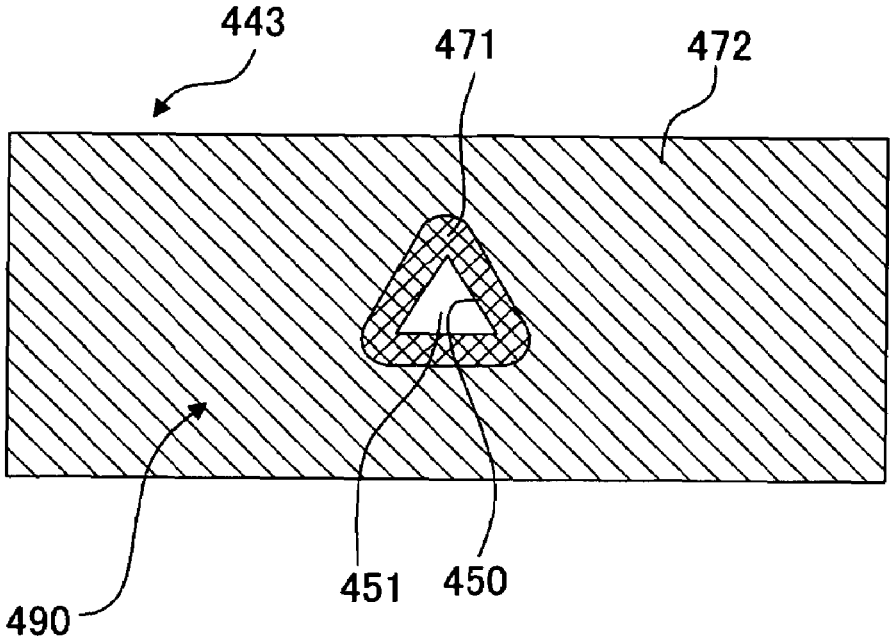
FIG. 16A is a plan view of a nozzle plate of a third modified embodiment corresponding to FIG. 5, when the shape of an ejecting port of the nozzle is triangular.
Figure 16B:
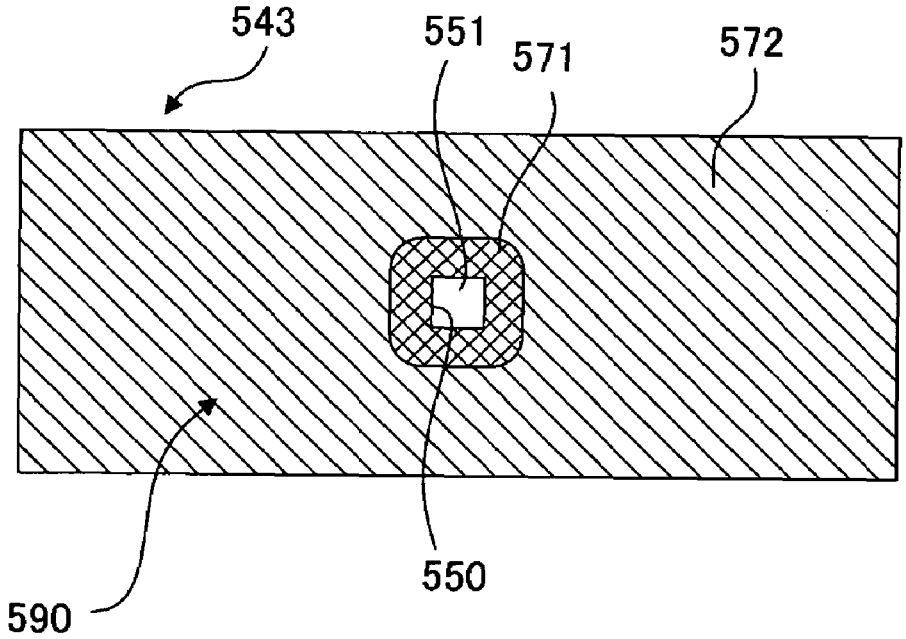
FIG. 16B is a plan view of a nozzle plate of a third modified embodiment corresponding to FIG. 5, when the shape of the ejecting port of the nozzle is rectangular.

In the present embodiment, the shape of the ejecting port 51 of the nozzle 50 is circular. However, the shape of the ejecting port 51 is not limited to the circular shape and may take other shape. As an example, FIG. 16A shows a nozzle 450 in which the shape of an ejecting port 451 formed in an ink discharge surface 490 is triangular. FIG. 16B shows a nozzle 550 in which the shape of an ejecting port 551 formed in an ink discharge surface 590 is rectangular.

When the shape of the ejecting port 451 is triangular as shown in FIG. 16A, the boundary between a first liquid repellent film 471 and a second liquid repellent film 472 is triangular in shape which is substantially similar to the shape of the ejecting port 451. Angles of this triangle are round and have shape of a circular arc and the center of gravity of the triangle coincides with the center of gravity of the ejecting port 451. In other words, the boundary between the first liquid repellent film 471 and the second liquid repellent film 472 is provided such that the shortest distance from the circumference of the ejecting port 451 of the nozzle 450 is always constant.

In this case, the ink overflowed to the outside from the nozzle 450 at the time of ink discharge is spread only over the entire area of the first liquid repellent film 471 and is not moved from the first liquid repellent film 471 to the second liquid repellent film 472. Therefore, the shape of the ink on the ink discharge surface 490 is same as the shape of the boundary between the first liquid repellent film 471 and the second liquid repellent film 472. Thereafter, the ink is drawn uniformly into the nozzle 450 with the center of gravity of the ejecting port 451 as a center. Therefore, the shape of the meniscus of ink in the nozzle 450 after the ink is drawn into the nozzle 450 is stable and the shift in the direction of discharge of ink can be prevented.

On the other hand, when the shape of the ejecting port 551 is rectangular as shown in FIG. 16B, the boundary between the first liquid repellent film 571 and a second liquid repellent film 572 is rectangular in shape which is substantially similar to the shape of the ejecting port 550. Angles of this rectangle are round and have shape of a circular arc and the center of gravity of the rectangle coincides with the center of gravity of the ejecting port 550. In other words, the boundary between the first liquid repellent film 571 and the second liquid repellent film 572 is provided such that the shortest distance from the circumference of the ejecting port 551 of the nozzle 550 is always constant.

In this case also, similarly, the ink overflowed to the outside from the nozzle 550 at the time of ink discharge is spread only over the entire area of the first liquid repellent film 571 and is not moved from the first liquid repellent film 571 to the second liquid repellent film 572. Therefore, the shape of the ink on the ink discharge surface 590 is same as the shape of the boundary between the first liquid repellent film 571 and the second liquid repellent film 572. Thereafter, the ink is drawn uniformly into the nozzle 550 with the center of gravity of the ejecting port as a center. Therefore, the shape of the meniscus of ink in the nozzle 550 after the ink is drawn into the nozzle 550 is stable and the shift in the direction of discharge of ink can be prevented.

Fourth Modified Embodiment

A nozzle plate 143 may be formed of a metallic material such as stainless steel. In this case, the nozzle plate 143 as shown in FIG. 17F is manufactured as described below. FIG. 17 (17A to 17F) is a process diagram showing steps for manufacturing the nozzle plate 143 made of the metallic material.

Figure 17A:
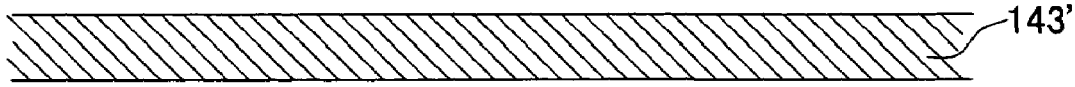
FIG. 17 (17A to 17F) is a process diagram showing steps for producing a nozzle plate of a fourth modified embodiment made of a metallic material.
Figure 17B:
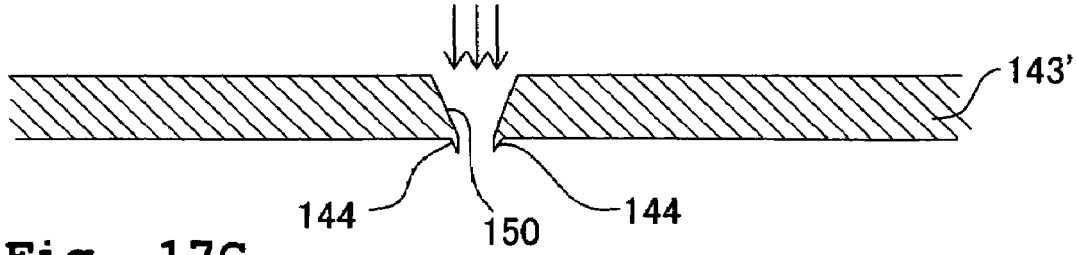
Figure 17C:
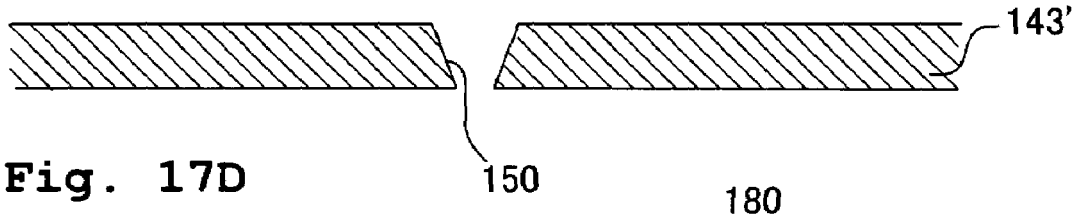

First, a nozzle 150 is formed by irradiating, from one surface of the substrate 143' shown in FIG. 17A, excimer laser beam or the like as shown in FIG. 17B (nozzle forming step). At this time, a burr 144 or the like is developed on the other surface of the substrate 143' on a side opposite to the surface on which the excimer laser beam is irradiated. Accordingly, the burr 144 is removed as shown in FIG. 17C.

Figure 17D:
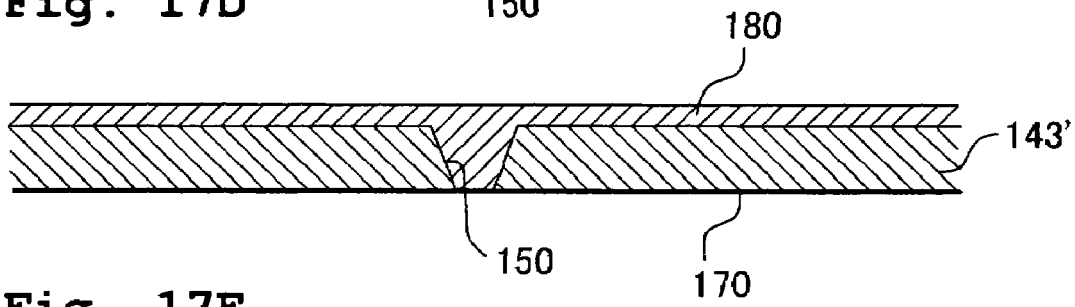

Next, a resist 180 is coated on the one surface of the substrate 143' as shown in FIG. 17D. At this time, the coated resist 180 is filled up into the nozzle 150 by a capillary force. Thereafter, a fluorine based resin is coated on the other surface of the substrate 143' to form a liquid repellent film 170 (liquid repellent film forming step). Further, a resist 181 is formed by clamping, by a roller or the like, a thermosetting resin in the form of a film while heating the thermosetting resin, at an area except for a portion of the surface of the liquid repellent film 170 in which the nozzle 150 and a first liquid repellent film 171 are to be formed.

Figure 17E:
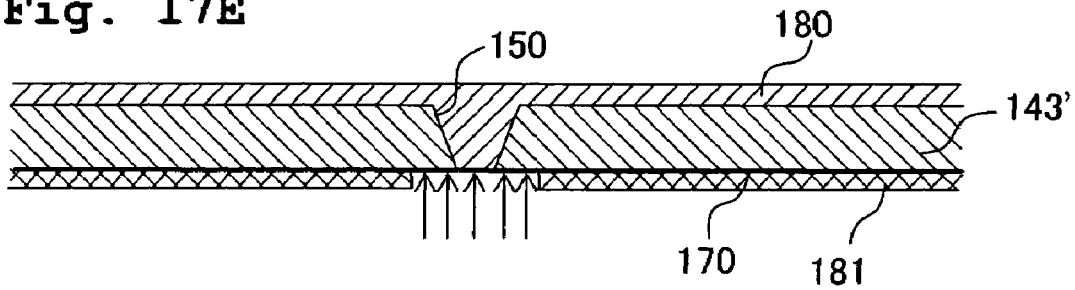
Figure 17F:
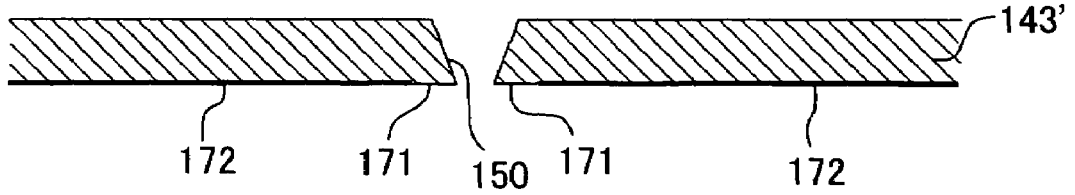

Next, as shown in FIG. 17E, light ray such as laser beam is irradiated on an exposed portion of the liquid repellent film 170 which is not covered by the resist 180, and the liquid repellent quality of the portion in which the resist 180 is not formed is allowed to be lowered by causing the liquid repellent film 170 on the portion to be degraded, and a portion of the liquid repellent film 170 corresponding to the nozzle 150 is removed (light ray irradiating step). Accordingly, the portion of the liquid repellent film 170 having the liquid repellent property lowered by being irradiated with the laser beam becomes the first liquid repellent film 171, and the portion which was covered by the resist 181 and on which the laser beam was not irradiated becomes the second liquid repellent film 172. Further, as shown in FIG. 17F, the resists 180 and 181 are removed by being dissolving with a solvent, and the nozzle plate 143 is manufactured.

When the nozzle 150 is formed in the metallic substrate 143' a burr 144 is developed. However, when the first liquid repellent film 171 and the second liquid repellent film 172 are formed in this manner after forming the nozzle 150, the burr 144 can be removed before forming the first liquid repellent film 171 and the second liquid repellent film 172. Therefore, the surface of the nozzle plate 143 can be flattened and smoothened before forming the first liquid repellent film 171 and the second liquid repellent film 172. Moreover, since the nozzle plate 143 is metallic, the nozzle plate 143 can be joined simultaneously to the other plates 40 to 42 by a method such as diffusion joining, and in this case the manufacturing process can be simplified.

In the present embodiment, an example in which the liquid transporting apparatus of the present invention is applied to the ink-jet head is described. However, the scope of application of this liquid transporting apparatus is not limited to the ink-jet head.

What is claimed is:

1. A liquid droplet jetting apparatus comprising:

a nozzle plate which includes a nozzle which discharges a liquid droplet, and a liquid droplet discharge surface in which an ejecting port of the nozzle is formed; and a channel unit which communicates with the nozzle, wherein the liquid droplet discharge surface includes a first liquid repellent area which surrounds the ejecting port, and a second liquid repellent area which is adjacent to the first liquid repellent area and which surrounds the first liquid repellent area; and a liquid repellent property of the first liquid repellent area is lower than a liquid repellent property of the second liquid repellent area.

2. The liquid droplet jetting apparatus according to claim 1, wherein a boundary between the first liquid repellent area and the second liquid repellent area is provided such that a shortest distance with respect to a circumference of the ejecting port is always constant.

3. The liquid droplet jetting apparatus according to claim 2, wherein the ejecting port has a circular shape.

4. The liquid droplet jetting apparatus according to claim 3, wherein the first liquid repellent area surrounds the ejecting port in concentric with the ejecting port.

5. The liquid droplet jetting apparatus according to claim 4, wherein a width of an outer circumference of the first liquid repellent area is in a range of 1.1times to 1.5times of a diameter of the ejecting port.

6. The liquid droplet jetting apparatus according to claim 2, wherein the liquid repellent property of the first liquid repellent area is higher than a liquid repellent property of an inner surface of the nozzle.

7. The liquid droplet jetting apparatus according to claim 2, wherein a wetting angle of the second liquid repellent area is greater, by not less than 20°, than a wetting angle of the first liquid repellent area.

8. The liquid droplet jetting apparatus according to claim 1, wherein the liquid droplet jetting apparatus is an ink-jet head.

9. A nozzle plate comprising:

a nozzle which discharges a liquid droplet; and a liquid droplet discharge surface in which an ejecting port of the nozzle is formed, wherein the liquid droplet discharge surface includes a first liquid repellent area which surrounds the ejecting port, and a second liquid repellent area which is adjacent to the first liquid repellent area and which surrounds the first liquid repellent area; and a liquid repellent property of the first liquid repellent area is lower than a liquid repellent property of the second liquid repellent area.

10. The nozzle plate according to claim 9, wherein a boundary between the first liquid repellent area and the second liquid repellent area is provided such that a shortest distance with respect to a circumference of the ejecting port is always constant.

11. The nozzle plate according to claim 10, wherein the ejecting port has a circular shape.

12. The nozzle plate according to claim 10, wherein the liquid repellent property of the first liquid repellent area is higher than a liquid repellent property of an inner surface of the nozzle.

13. The nozzle plate according to claim 9, wherein a wetting angle of the second liquid repellent area is greater, by not less than 20°, than a wetting angle of the first liquid repellent area.

14. The nozzle plate according to claim 9, wherein the first liquid repellent area surrounds the ejecting port in concentric with the ejecting port.

15. The nozzle plate according to claim 14, wherein a width of an outer circumference of the first liquid repellent area is in a range of 1.1 times to 1.5 times of a diameter of the ejecting port.

16. A method of producing a nozzle plate, the method comprising:

forming a nozzle on a substrate;

forming a liquid repellent on one surface of the substrate in which the nozzle is formed; and irradiating a light ray on a portion of the liquid repellent film which surrounds an ejecting port of the nozzle to form a first liquid repellent area in which a liquid repellent property is partially lowered.

17. The method of producing the nozzle plate according to claim 16, wherein the substrate is formed of a metallic material, and a nozzle forming step of forming the nozzle in the substrate is performed before the liquid repellent film forming step.

18. The method of producing the nozzle plate according to claim 16, wherein the substrate is formed of a synthetic resin material, and a nozzle plate forming step of forming the nozzle in the substrate is performed after the light ray irradiating step.

* * * * *